US008770719B2

(12) United States Patent
Ishikawa et al.

(10) Patent No.: US 8,770,719 B2
(45) Date of Patent: Jul. 8, 2014

(54) LIQUID DISCHARGE HEAD

(75) Inventors: Tetsushi Ishikawa, Tokyo (JP); Tamaki Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/543,092

(22) Filed: Jul. 6, 2012

(65) Prior Publication Data

US 2013/0027469 A1 Jan. 31, 2013

(30) Foreign Application Priority Data

Jul. 27, 2011 (JP) ..... 2011-164173

(51) Int. Cl.
*B41J 2/14* (2006.01)

(52) U.S. Cl.
USPC ..... 347/47

(58) Field of Classification Search
USPC ..... 347/47, 40, 43, 64–65
See application file for complete search history.

(56) References Cited

U.S. PATENT DOCUMENTS

| | | | | |
|---|---|---|---|---|
| 6,960,424 | B2 | 11/2005 | Miyagawa et al. | |
| 7,526,863 | B2 | 5/2009 | Miyagawa et al. | |
| 7,909,428 | B2 * | 3/2011 | Donaldson et al. | 347/20 |
| 7,980,675 | B2 | 7/2011 | Suzuki et al. | |
| 8,191,260 | B2 | 6/2012 | Kato et al. | |
| 8,227,043 | B2 | 7/2012 | Kubota et al. | |
| 2009/0133256 | A1 | 5/2009 | Okano et al. | |

FOREIGN PATENT DOCUMENTS

| | | | |
|---|---|---|---|
| JP | 61-37439 | A | 2/1986 |
| JP | 2003-25595 | A | 1/2005 |

* cited by examiner

*Primary Examiner* — Lamson Nguyen
(74) *Attorney, Agent, or Firm* — Fitzpatrick, Cella, Harper & Scinto

(57) ABSTRACT

A liquid discharge head includes a first substrate having an energy generating element for discharging a liquid, and a second substrate which is bonded to the first substrate and which has a discharge port for discharging the liquid and a groove that forms a passage for supplying the liquid to the energy generating element, wherein one surface of the second substrate on the front surface side of the liquid discharge head and the other surface thereof, which is the back surface of the one surface, are individually provided with recesses.

6 Claims, 10 Drawing Sheets

LIQUID DISCHARGE HEAD

BACKGROUND OF THE INVENTION

1. Field of the Invention

The present invention relates to a liquid discharge head used with an ink jet recording apparatus.

2. Description of the Related Art

A recording apparatus that is configured with an ink jet method, namely, an ink jet recording apparatus, is adapted to discharge and blow a liquid (recording liquid) from the discharge ports of nozzles of a liquid discharge head onto a recording medium thereby to effect recording.

The configuration of the aforesaid type of liquid discharge head has a silicon substrate provided, on the front surface thereof, with electric wiring and a plurality of energy generating elements, which generate energy for discharging a liquid, and an orifice substrate, which is made of a resin material and which is deposited on the silicon substrate. The orifice substrate has nozzles provided at positions corresponding to the energy generating elements. Each of the nozzles has a bubble forming chamber in which air bubbles are generated by an energy generating element and a fine discharge port through which a liquid is discharged. Further, a groove provided in the orifice substrate and the silicon substrate together form a passage for supplying the liquid from a liquid supply port to a nozzle, which will be discussed later. A liquid supply port for supplying the liquid from a liquid tank or the like is provided in the silicon substrate such that the liquid supply port penetrates the silicon substrate. The liquid is supplied from the liquid tank or the like to the nozzle through the liquid supply port and the passage.

In the liquid discharge head constructed as described above, the liquid supplied from the back surface of the silicon substrate is passed through the liquid supply port and the passage and charged into the bubble forming chamber of each nozzle. The liquid filled in the bubble forming chamber is pushed out in a direction substantially orthogonal to the silicon substrate by an air bubble generated from film boiling by the energy generating element. Thus, the liquid is discharged from the discharge port.

To satisfy the need for a higher recording quality and recording at higher speed, an ink jet recording apparatus is required to have a higher density of the nozzles thereof and to achieve smaller droplets of a liquid to be discharged. The higher density of the nozzles has been achieved by, for example, forming the orifice substrate by using a photosensitive resin material and carrying the patterning by a photolithographic technique. The smaller droplets have been achieved by reducing the diameter of each discharge port and the size of each bubble forming chamber. To reduce the size of the bubble forming chamber, the distance between the front surface of the orifice substrate and the surface of the energy generating element, i.e., the heater (hereinafter referred to as "the OH distance"), has been designed to be shorter.

As one method for shortening the OH distance, the orifice substrate is made thinner. According to, for example, Japanese Patent Application Laid-Open No. S61-037439, only the area of an orifice substrate in the vicinity of a discharge port involved in the discharge characteristics of a liquid is made thinner, while the remaining area is made thick to enhance the strength of the orifice substrate, thus achieving a reduced OH distance. Hence, the front surface of the orifice substrate, i.e., the surface opposite from the silicon substrate, is shaped to have a recess around each discharge port. However, there is limitation on reducing the thickness of the orifice substrate due to the required strength of the substrate.

Another method for reducing the OH distance is to reduce the height of a passage. In this case, the OH distance can be shortened by reducing the interval between the front surface of the silicon substrate, which is the surface with the energy generating elements disposed thereon, and the back surface of the orifice substrate. However, reducing the height of the passage inconveniently increases the passage resistance, resulting in longer time required for nozzles to be refilled with a liquid. This is disadvantageous for achieving higher-speed recording. As a solution, Japanese Patent Application Laid-Open No. 2003-025595, for example, discloses a method in which the height of a part of a passage is increased by providing a portion constituting the passage in the back surface of an orifice substrate with a recess (hereinafter referred to as "the back surface groove") so as to allow nozzles to be refilled with a liquid at high speed and also to reduce the OH distance at the same time. According to this method, the height of the passage is increased while reducing the OH distance, so that a reduced passage resistance and high-speed refilling of a liquid can be achieved.

However, the method disclosed in Japanese Patent Application Laid-Open No. 2003-025595 poses the problems described below.

(1) The resin material constituting the orifice substrate shrinks during the production process of a liquid discharge head.

(2) The amount of shrinkage of the orifice substrate in the direction parallel to a plane differs between an area near the front surface and an area near the back surface of the orifice substrate.

Because of the two problems mentioned above, deformation in which the orifice substrate decreases the height of the passage at the position of the back surface groove takes place, meaning that the orifice substrate warps toward the silicon substrate. The deformation gives rise to a problem in that the passage resistance increases, adversely affecting the refilling of the liquid.

More specifically, in the manufacturing process of the liquid discharge head having the orifice substrate made of a resin material, curing is generally carried out in a final process to provide resistance to liquid and adhesion between substrates. The curing process causes the orifice substrate made of a standard resin material to shrink by about a few percent to about ten-odd percent. In the orifice substrate having a back surface groove, the side portions of the back surface groove project toward the silicon substrate, so that the orifice substrate will have unfixed free ends in the direction parallel to the plane. This inconveniently leads to an increased amount of shrinkage of the side portions of the back surface groove of the orifice substrate. As a result, a tensile stress occurs in the vicinity of the back surface groove. Consequently, after the curing process, the orifice substrate in the vicinity of the back surface groove develops the deformation that reduces the height of the passage, i.e., the orifice substrate warps toward the silicon substrate. Thus, the passage becomes lower than a desired height and the effect provided by the back surface groove is undesirably impaired. As a possible solution, the depth of the back surface groove could be increased to compensate for the reduction in the height of the passage caused by the curing process. This, however, causes the orifice substrate to become excessively thin at the back surface groove, presenting another problem, namely, inadequate strength. The orifice substrate could be made of a material that does not shrink during the curing process. However, the material constituting the liquid discharge head is required to have characteristics suited for a liquid to be used, such as the elution to the liquid and adhesion, thus it would leave an unsolved problem because of the limited choice of available materials.

SUMMARY OF THE INVENTION

In view of the problems described above, a liquid discharge head in accordance with the present invention includes a first substrate which has an energy generating element for discharging a liquid and a second substrate which is bonded to the first substrate and which has a discharge port, through which the liquid is discharged, and a groove constituting a passage for supplying the liquid to the energy generating element, wherein one surface of the second substrate on the front surface side of the liquid discharge head and the other surface thereof, which is the back surface of the one surface, are individually provided with recesses.

Further features of the present invention will become apparent from the following description of exemplary embodiments with reference to the attached drawings.

DESCRIPTION OF THE EMBODIMENTS

Figure 1A:
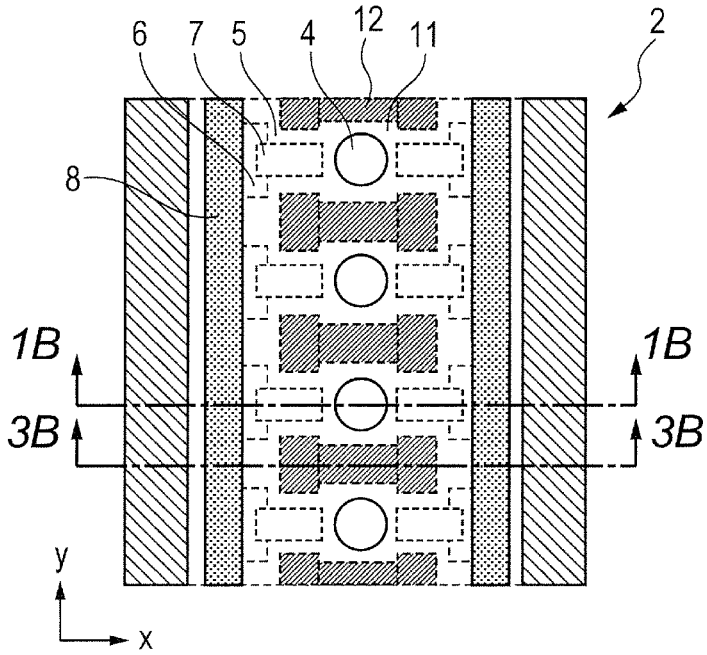
FIGS. 1A and 1B are schematic configuration diagrams illustrating an embodiment of a liquid discharge head according to the present invention.

In the following embodiments of the present invention described in detail with reference to the accompanying drawings, configurations having the same functions will be assigned the same reference numerals in the accompanying drawings and the descriptions thereof may be omitted.

First Embodiment

Figure 1B:
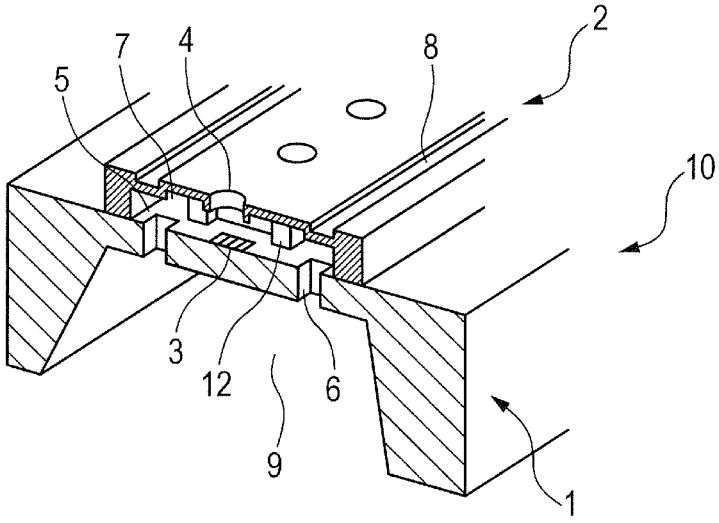

FIGS. 1A and 1B are schematic configuration diagrams of an embodiment of a liquid discharge head for an ink jet recording apparatus in accordance with the present invention. FIG. 1A is a schematic configuration diagram of the liquid discharge head observed from the front surface of the liquid discharge head, while FIG. 1B is a schematic perspective view of a section taken at 1B-1B in FIG. 1A.

A liquid discharge head 10 for an ink jet recording apparatus is constituted of a silicon substrate (a first substrate) 1 and an orifice substrate (a second substrate) 2 made of a resin material deposited on the silicon substrate 1. The orifice substrate 2, for example, extends in one direction, and more specifically, has a rectangular shape.

A plurality of energy generating elements 3 is disposed on the front surface of the silicon substrate 1. Further, the back surface of the silicon substrate 1 is provided with a common liquid chamber 9, and liquid supply ports 6, which are arranged at positions to interpose the energy generating elements 3 therebetween and penetrate the silicon substrate 1, meaning that the liquid supply ports 6 are in communication with the common liquid chamber 9.

The orifice substrate 2 is disposed on the front surface of the silicon substrate 1. The orifice substrate 2 is provided with nozzles at the positions corresponding to the energy generating elements on the silicon substrate 1. Each nozzle has a bubble forming chamber 11, in which air bubbles are generated by the energy generating element 3, and a fine discharge port 4 through which a liquid is discharged from the bubble forming chamber 11 to the outside. The nozzles are separated by walls 12. In other words, each of the bubble forming chambers 11 is formed by being surrounded by the walls 12. Further, the orifice substrate 2 is provided with grooves. The grooves and the silicon substrate 1 together form passages 5 that supply the liquid from the liquid supply ports 6 to the bubble forming chambers 11. The front surface (one surface) of the orifice substrate 2 has front surface grooves 8, which are concave portions recessed from the front surface toward the back surface (the other surface), while the back surface thereof has back surface grooves 7, which are concave portions recessed from the back surface toward the front surface. The front surface grooves 8 extend in the longitudinal direction in the vicinity of both lateral edges of the orifice substrate 2. The back surface grooves 7 are positioned so as to constitute the passages 5. The front surface grooves 8 and the back surface grooves 7 will be discussed later. Further, the liquid is supplied to the common liquid chamber 9 from a liquid tank or the like, which is not illustrated.

Figure 2A:
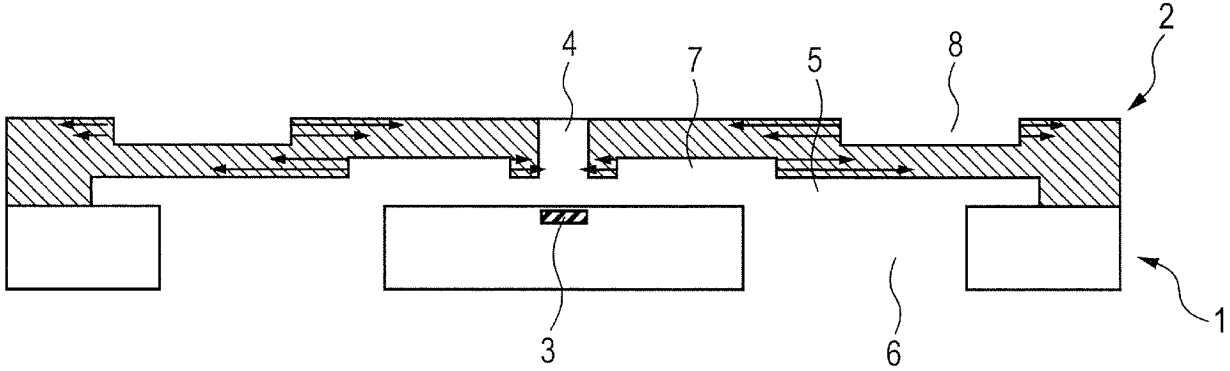
FIGS. 2A and 2B are diagrams illustrating the direction of the shrinkage and the deformation of an orifice substrate that take place during a curing process.
Figure 2B:
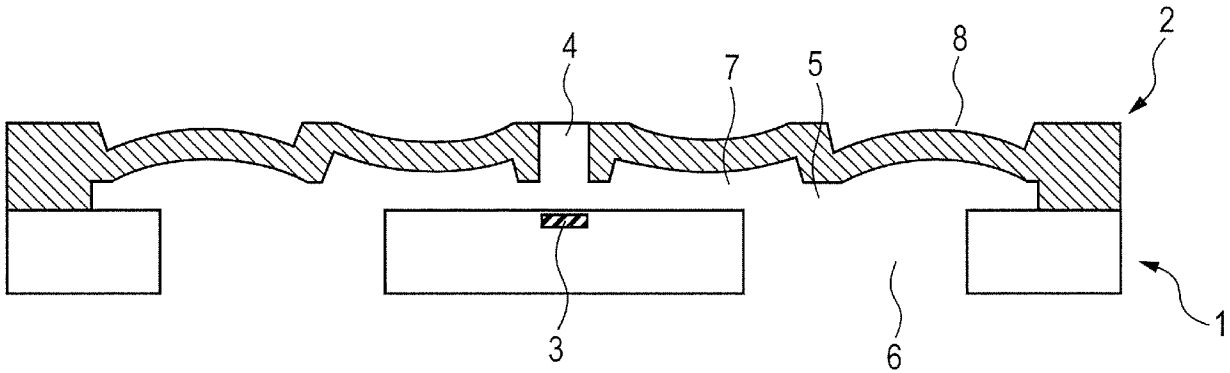

FIGS. 2A and 2B are diagrams illustrating the direction of shrinkage and the deformation of the orifice substrate 2 at section 1B-1B, which take place during a curing process. FIG. 2A illustrates the directions of the shrinkage, while FIG. 2B illustrates the deformation. As indicated by the arrows in FIG. 2A, the curing process causes a shrinking stress to act on the side portions of the back surface grooves 7 and the front surface grooves 8. As a result, as illustrated in FIG. 2B, the orifice substrate 2 deforms such that the height of the passage 5 is decreased at the position of the back surface groove 7, whereas the orifice substrate 2 deforms in a direction away from the silicon substrate 1 at the position of the front surface groove 8 of the orifice substrate 2. Hence, it is possible to mitigate the deformation that leads to a reduced height of the passage 5 in the orifice substrate 2 at the position of the back surface groove 7.

Figure 3A:
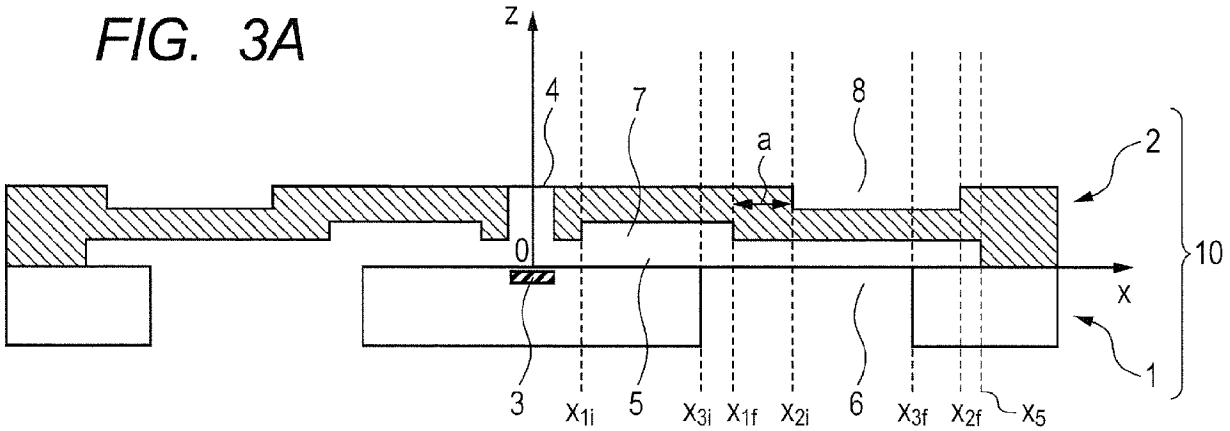
FIGS. 3A and 3B are schematic diagrams illustrating the positional relationship between a groove in a front surface and a groove in a back surface.
Figure 3B:
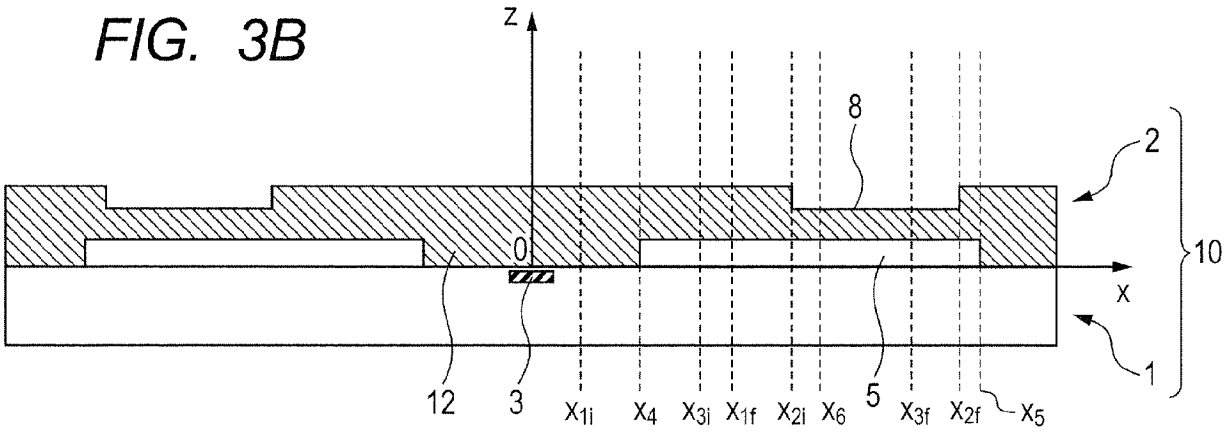

The positional relationship between the front surface grooves 8 and the back surface grooves 7 will be described in detail with reference to FIGS. 3A and 3B. FIGS. 3A and 3B are schematic diagrams illustrating the positional relationship between one of the front surface grooves 8 and one of the back surface grooves 7. FIG. 3A is a schematic diagram of section 1B-1B in FIG. 1A, while FIG. 3B is a schematic diagram of section 3B-3B in FIG. 1A. The lateral direction of the silicon substrate 1 is denoted by x, the longitudinal direction thereof is denoted by y (refer to FIG. 1A), the direction perpendicular to the front surface of the silicon substrate 1 is denoted by z, and the center of each of the energy generating elements 3 is denoted by 0. Further, in the lateral direction (the x-direction) of the orifice substrate 2, the positions of the ends of the back surface groove 7, the front surface groove 8 and the liquid supply port 6 that are close to position 0 are defined as the initial positions, while the positions away from position 0 are defined as the final positions.

The distance of each position from position 0 is denoted as follows. The initial position of the back surface groove 7 is denoted by $x_{1i}$, the final position of the back surface groove 7 is denoted by $x_{1f}$, the initial position of the front surface groove 8 is denoted by $x_{2i}$, the final position of the front surface groove 8 is denoted by $x_{2f}$, the initial position of the liquid supply port 6 is denoted by $x_{3i}$, the final position of the liquid supply port 6 is denoted by $x_{3f}$, the position of the wall 12 at the end in the lateral direction of the orifice substrate 2 is denoted by $x_4$, the position of the end of an edge portion of the orifice substrate 2, which edge portion is bonded to the silicon substrate 1 and which end of the edge portion is adjacent to a central portion of the orifice substrate 2, is denoted by $x_5$, and the midpoint between position $x_4$ and $x_5$ is denoted by $x_6$.

The back surface groove 7 is further preferably disposed such that the following conditions are satisfied.

(1) Final position $x_{1f}$ of the back surface groove 7>Initial position $x_{3i}$ of the liquid supply port 6

(2) Initial position $x_{1i}$ of the back surface groove 7 is minimized as much as possible (3) Final position $x_{1f}$ of the back surface groove 7<Midpoint $x_6$ between position $x_4$ and position $x_5$ Regarding (1), the quick refilling of a liquid is interfered by the height of the passage 5 being reduced by the curing process. Hence, the overlapping of the back surface groove 7 and the liquid supply port 6 in the lateral direction of the silicon substrate 1 (when the liquid discharge head 10 is observed from the front surface side) is advantageous for the quick refilling of the liquid. Thus, the positional relationship indicated in (1) is preferable.

Regarding (2), as the initial position of the back surface groove 7 becomes closer to the discharge port 4, the area in which the passage 5 is low becomes smaller. This, therefore, is effective for the refilling of the liquid to be accomplished at higher speed. It is desirable, however, that the initial position of the back surface groove 7 is set to be close to the discharge port 4 within a range that will not deteriorate discharge characteristics or not cause the orifice substrate 2 to crack or interfere with the manufacture.

Regarding (3), when manufacturing the liquid discharge head 10, the place in the orifice substrate 2 where the deformation occurs most frequently is the place away from the position where the orifice substrate 2 and the silicon substrate 1 are bonded. Therefore, position $x_6$, which is the midpoint between position $x_4$ and $x_5$, corresponds to the place most frequently subject to the deformation. For this reason, more preferably, the back surface groove 7, in which the deformation that leads to a reduced height of the passage 5 takes place, does not include position $x_6$.

The back surface groove 7 is advantageously deeper for the refilling of the liquid. However, an increase of the depth of the back surface groove 7 means a reduction of the thickness of the orifice substrate 2. Hence, ensuring adequate strength of the orifice substrate automatically limits the increase of the depth of the back surface groove 7.

The front surface groove 8 is further preferably disposed such that the following conditions are satisfied.

(1) Final position $x_{1f}$ of the back surface groove 7<Initial position $x_{2i}$ of the front surface groove 8

(2) Final position $x_{2f}$ of the front surface groove 8<Position $x_5$ (3) Initial position $x_{2i}$ of the front surface groove 8<Midpoint $x_6$ between position $x_4$ and position $x_5$ Regarding (1), the back surface groove 7 is disposed near the discharge port 4, as described above. Further, if the back surface groove 7 and the front surface groove 8 overlap when observed from the front surface side of the liquid discharge head 10, then an excessively thin area in the orifice substrate 2 would result, which would lead to inadequate strength. Thus, the positional relationship indicated in (1) is preferable. If a distance "a" between initial position $x_{2i}$ of the front surface groove 8 and final position $x_{1f}$ of the back surface groove 7 is small, then the stress developed in the curing process may cause a crack in the orifice substrate 2. Hence, the distance "a" is required to be set such that the orifice substrate 2 will not be cracked.

Regarding (2), if the front surface groove 8 is right above position $x_5$, then the deformation of the orifice substrate 2 in the front surface groove 8 is restricted, inconveniently limiting the deformation that increases the height of the passage 5 of the orifice substrate 2. For this reason, the positional relationship indicated in (2) is preferable to further enhance the effect provided by the formation of the front surface groove 8.

Regarding (3), the area of position $x_6$, which is the midpoint between position $x_4$ and position $x_5$, is most likely to be displaced, as described above. Hence, the front surface groove 8 is preferably disposed to include position $x_6$ and more preferably has the positional relationship indicated in (3).

Figure 4:
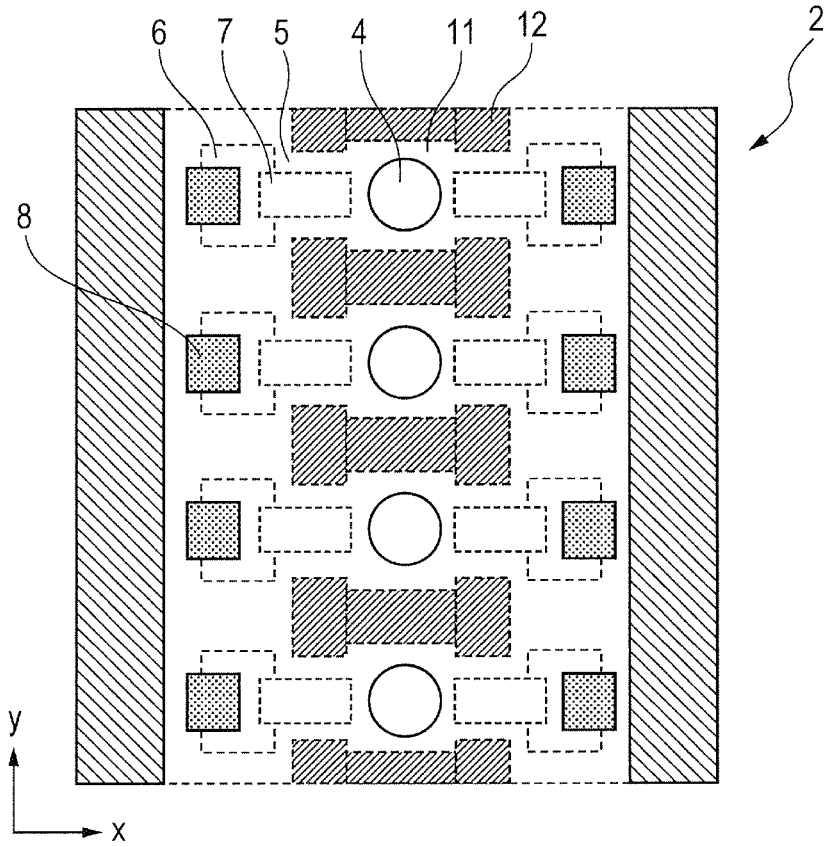
FIG. 4 is a schematic configuration diagram illustrating a liquid discharge head having a split groove in the front surface.

In the liquid discharge head 10 illustrated in FIGS. 1A and 1B, the front surface groove 8 extends in the longitudinal direction in the vicinity of both ends in the lateral direction of the orifice substrate 2. Alternatively, however, the front surface groove 8 may be provided in a split manner at only the position that the discharge port 4 are interposed between the split grooves, as illustrated in FIG. 4.

Figure 5A:
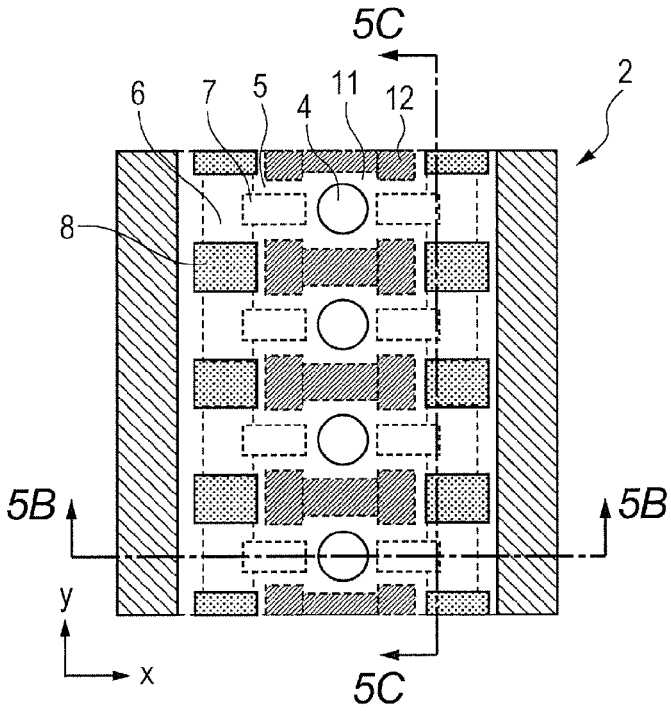
FIGS. 5A, 5B and 5C are schematic configuration diagrams illustrating another configuration of a liquid discharge head provided with a split groove in the front surface.
Figure 5B:
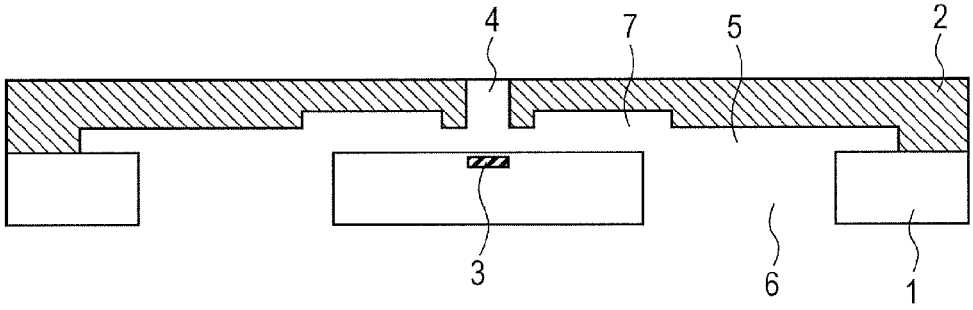
Figure 5C:
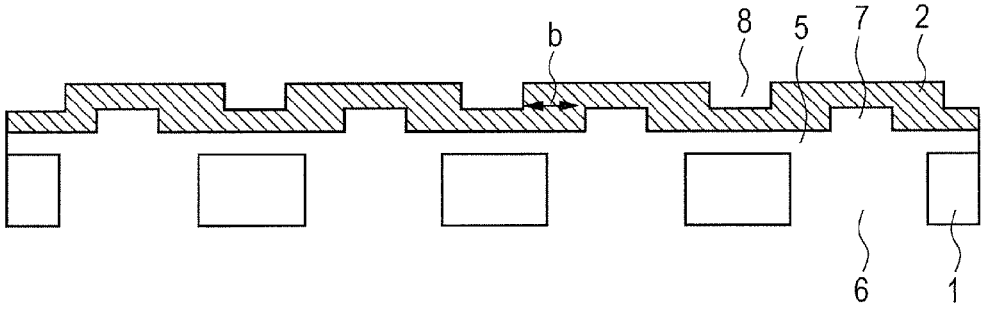

Another configuration in which the front surface groove 8 is split and disposed will be described with reference to FIGS. 5A, 5B and 5C. FIGS. 5A, 5B and 5C are schematic configuration diagrams illustrating another configuration of the liquid discharge head 10 in which the split front surface grooves 8 are provided. FIG. 5A is a schematic configuration diagram of the liquid discharge head 10 observed from the front surface of the liquid discharge head 10, FIG. 5B is a schematic diagram of section 5B-5B in FIG. 5A, and FIG. 5C is a schematic diagram of section 5C-5C in FIG. 5A. Unlike the front surface grooves 8 illustrated in FIG. 4 described above, the split front surface grooves 8 are disposed at positions where the discharge ports 4 are not interposed thereby in the lateral direction of the orifice substrate 2.

In this case, the difference in the amount of shrinkage in the longitudinal direction of the orifice substrate 2 mitigates the deformation that leads to a reduced height of the passage 5 at the position of the back surface groove 7. Even in the case of the positional relationship in which the final position $x_{1f}$ of the back surface groove 7 is farther than the initial position $x_{2i}$ of the front surface groove 8, there will be no problem in that the orifice substrate 2 becomes excessively thin due to the overlapping of the back surface groove 7 and the front surface groove 8 as observed from the front surface of the liquid discharge head 10. A distance "b" shown in FIG. 5C is required to be a predetermined distance to prevent the orifice substrate 2 from becoming excessively thin. Further, as the front surface groove 8 becomes deeper, the effect of the deformation for increasing the height of the passage 5 is enhanced. However, increasing the depth makes the orifice substrate 2 thinner, so that the increase of the depth will be limited from the aspect of the strength of the orifice substrate 2.

Referring now to FIGS. 6A, 6B, 6C, 6D, 6E, 6F and 6G, the manufacturing method of the liquid discharge head 10 of the present embodiment will be described.

First, the energy generating elements 3 and semiconductor devices (not shown) for driving and controlling the energy generating elements 3 are provided on the silicon substrate 1. Then, an adhesion layer 110 is deposited on the front surface (the surface with the energy generating elements provided thereon) of the silicon substrate 1 and a mask layer 116 for forming the common liquid chamber 9 is deposited on the back surface thereof by using a photolithographic technique.

Figure 6A:
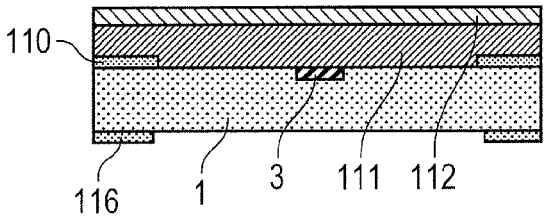
FIGS. 6A, 6B, 6C, 6D, 6E, 6F and 6G are diagrams illustrating the manufacturing method of the liquid discharge head according to the present invention.

Thereafter, a first layer 111 having a film thickness of 5 μm and a second layer 112 having a film thickness of 4 μm are deposited on the front surface of the silicon substrate 1 (refer to FIG. 6A). The first layer 111 and the second layer 112 are both formed of positive photosensitive resins, which have each different photosensitive wavelength ranges.

Figure 6B:
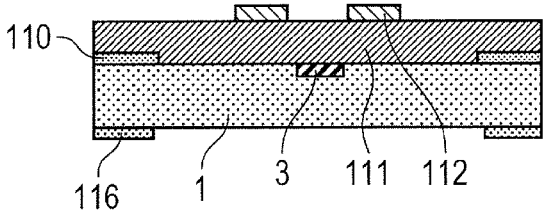

Subsequently, the portion to turn into the back surface groove 7 later is masked and exposed to ultraviolet rays which are of the photosensitive wavelength range of the second layer 112 but not of the photosensitive wavelength range of the first layer 111, then developed with a developer so as to selectively remove the second layer 112, thereby forming a pattern corresponding to the back surface groove 7 (refer to FIG. 6B). The dimensions of the back surface groove 7 are set to 20 μm×20 μm, and the distance between the end of the discharge port 4 and the end of the back surface groove 7, which will be formed later, is set to be approximately 4 μm.

Figure 6C:
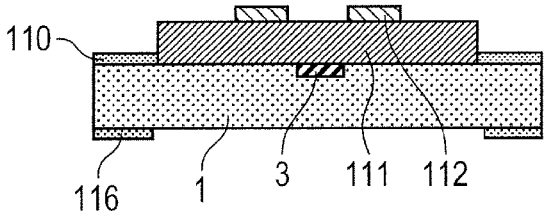
Figure 6D:
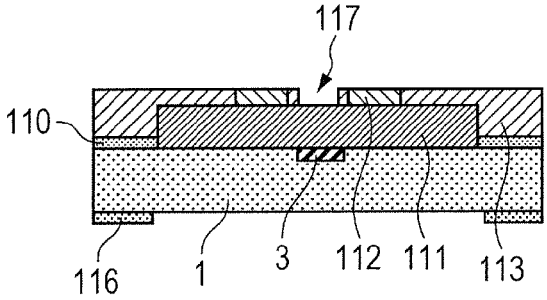
Figure 6E:
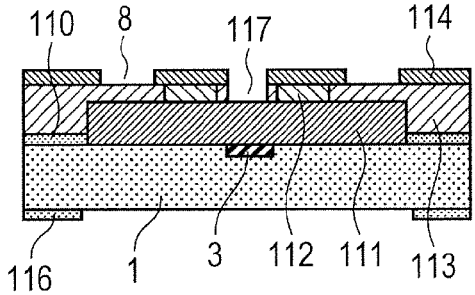
Figure 6F:
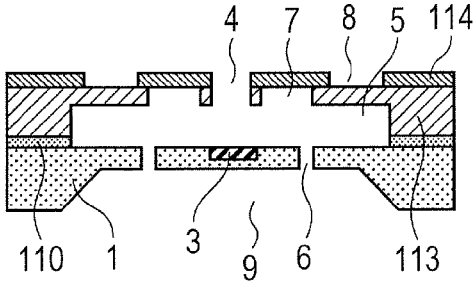

Subsequently, the portion to turn into the passage 5 later is masked and exposed to ultraviolet rays which are of the photosensitive wavelength range of the first layer 111 but not of the photosensitive wavelength range of the second layer 112 and developed, thus forming a pattern of the passage 5 (refer to FIG. 6C).

Subsequently, a negative photosensitive resin, such as SU-8 (Nippon Kayaku Co., Ltd.), is applied by spin coating and then dried so as to form a third layer 113. The third layer 113 is formed such that the interval between the front surface of the third layer 113 and the silicon substrate 1 is 4 μm. Then, the area except the portion that will turn into the discharge port 4 is masked, and the third layer 113 is exposed to ultraviolet rays. Next, development and post-baking are carried out to provide an area 117, which will turn into the discharge port 4 (refer to FIG. 6D).

Subsequently, to form the front surface groove 8, the same negative photosensitive resin as the material for the third layer 113 is applied by spin coating and dried thereby to form a fourth layer 114. The fourth layer 114 is deposited such that the interval between the front surface of the fourth layer 114 and the silicon substrate 1 is 7 μm. Then, the area except the portion that will turn into the front surface groove 8 is masked, and the fourth layer 114 is exposed to ultraviolet rays. Next, development and post-baking are carried out, thereby forming the front surface groove 8 (refer to FIG. 6E). The dimensions of the front surface groove 8 are set to 20 μm×20 μm in the case where the front surface groove 8 is split (refer to FIGS. 4 and 5A), or the width thereof is set to 20 μm in the case where the front surface groove 8 is extended in the longitudinal direction of the orifice substrate 2 (refer to FIG. 1A). In the lateral direction of the silicon substrate 1, the interval between the back surface groove 7 and the front surface groove 8 is set to approximately 3 μm. As an alternative, without forming the fourth layer 114, the third layer 113 may be made thicker and the front surface of the third layer 113 may be subjected to machining or laser machining to form the front surface groove 8.

After that, crystalline anisotropic etching is carried out to form the common liquid chamber 9 for supplying a liquid to the back surface of the silicon substrate 1, and dry etching is carried out to form the liquid supply port 6. Then, the first layer 111 and the second layer 112 are removed, thus completing the back surface groove 7 and the passage 5. Thereafter, the curing process is implemented (refer to FIG. 6F).

Figure 6G:
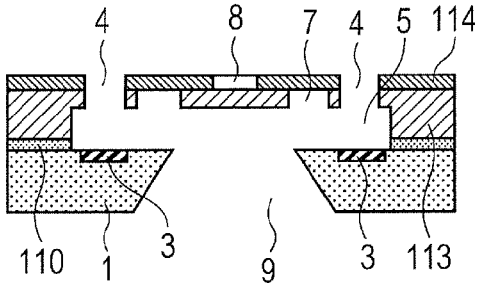

The liquid discharge head 10 is manufactured by carrying out the series of the process steps described above. Referring to FIGS. 6A to 6F, the liquid supply port 6 has been formed, while the energy generating element 3 is interposed therebetween. Alternatively, however, the liquid supply port may be provided only on one side of the energy generating element 3, as illustrated in FIG. 6G.

As described above, according to the present embodiment, the orifice substrate 2 deforms at the position of the back surface groove 7 such that the height of the passage 5 is reduced, whereas the orifice substrate 2 deforms in a direction away from the silicon substrate 1 at the position of the front surface groove 8. It enables to reduce the deformation of the orifice substrate 2 at the position of the back surface groove 7 that causes the height of the passage 5 to be reduced. Thus, the passage resistance decreases, allowing a liquid to be promptly charged into the nozzle (the bubble forming chamber 11) from the liquid supply port 6 through the passage 5.

Second Embodiment

Figure 7A:
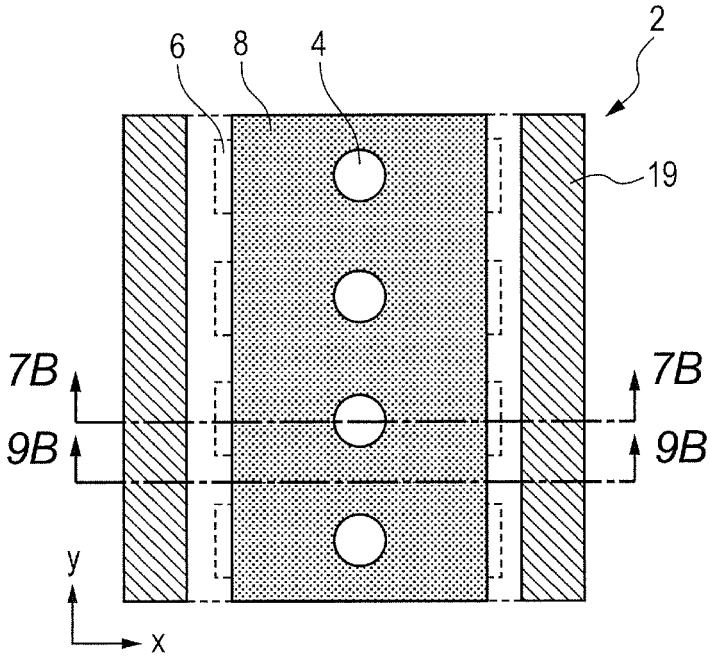
FIGS. 7A and 7B are schematic configuration diagrams illustrating a second embodiment of the liquid discharge head according to the present invention.
Figure 7B:
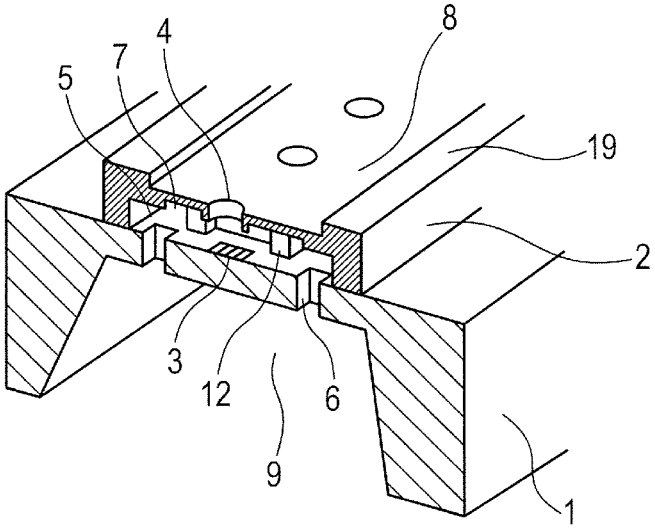

In a second embodiment of the liquid discharge head, the description of the same components as those in the embodiment described above will be omitted. FIGS. 7A and 7B are schematic configuration diagrams of the second embodiment of the liquid discharge head. FIG. 7A is the schematic configuration diagram of the liquid discharge head observed from the front surface of the liquid discharge head, and FIG. 7B is the schematic perspective view of section 7B-7B in FIG. 7A. The main difference of the present embodiment from the first embodiment is that a back surface groove 7 and a front surface groove 8 overlap in the lateral direction of a silicon substrate 1 (when the liquid discharge head 10 is observed from the front surface).

As described above, the distance between the front surface of the silicon substrate 1 and the front surface of the orifice substrate 2 is approximately as small as that in the first embodiment, and the orifice substrate 2 must not be excessively thin. Hence, in the second embodiment, thick portions 19 for adding the thickness to the orifice substrate 2 are provided in the vicinity of both ends in the lateral direction of the orifice substrate 2 such that the thick portions 19 project from the front surface of the orifice substrate 2. Thus, a front surface groove 8, which extends in the longitudinal direction and which is a recess that includes a discharge port 4, is formed at both edge portions in the lateral direction of the orifice substrate 2, i.e., at the central portion between the thick portions 19. A back surface groove 7 is provided at the position where a passage 5 is formed, as with the aforesaid embodiment, so that the back surface groove 7 and the front surface groove 8 partly overlap when observed from the front surface of a liquid discharge head 10.

In the present embodiment, the thick portions 19 are formed at both edges in the lateral direction of the orifice substrate 2, so that the strength of the orifice substrate 2 increases toward the edges in the lateral direction from the central portion. Further, the depth of the front surface groove 8 is substantially unrestricted, since the front surface groove 8 is formed by forming the thick portions 19.

Figure 8A:
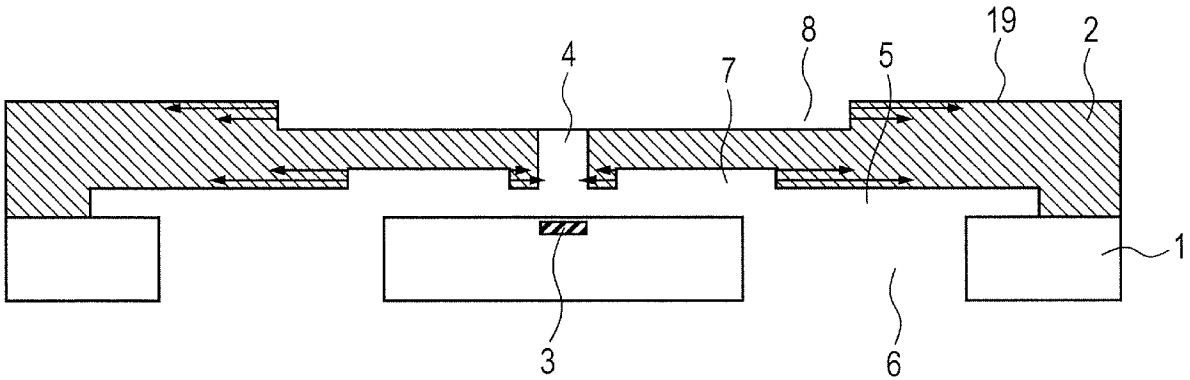
FIGS. 8A and 8B are diagrams illustrating the direction of the shrinkage and the deformation of an orifice substrate that take place during a curing process in the second embodiment.
Figure 8B:
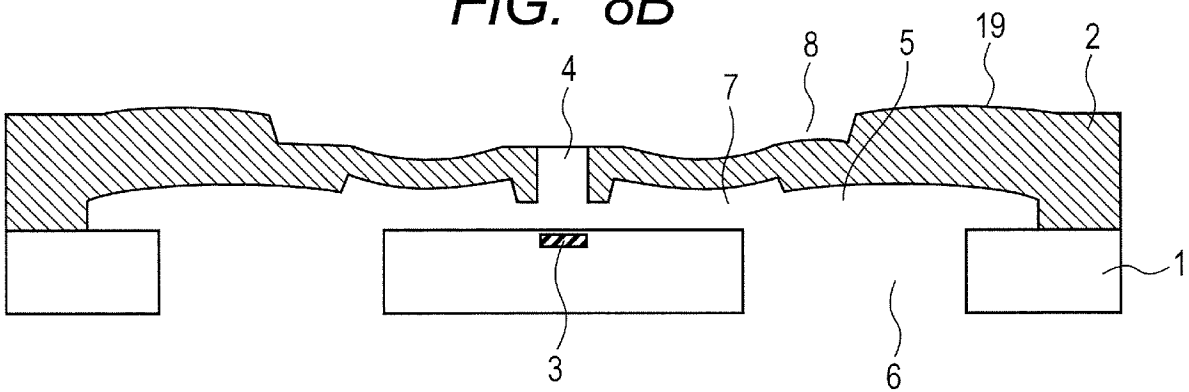

FIGS. 8A and 8B are diagrams illustrating the direction of shrinkage and the deformation of the orifice substrate 2 at section 7B-7B that occur in a curing process. FIG. 8A illustrates the directions of the shrinkage, and FIG. 8B illustrates the deformation. As illustrated in FIG. 8A, shrinkage stress laterally acts in the back surface groove 7 and the front surface groove 8. Hence, as illustrated in FIG. 8B, the orifice substrate 2 deforms in both directions, namely, toward the silicon substrate 1 and away from the silicon substrate 1 at the positions of the back surface groove 7 and the front surface groove 8 of the orifice substrate 2. As a result, therefore, the deformation that leads to a reduced height of the passage 5 can be restrained.

Figure 9A:
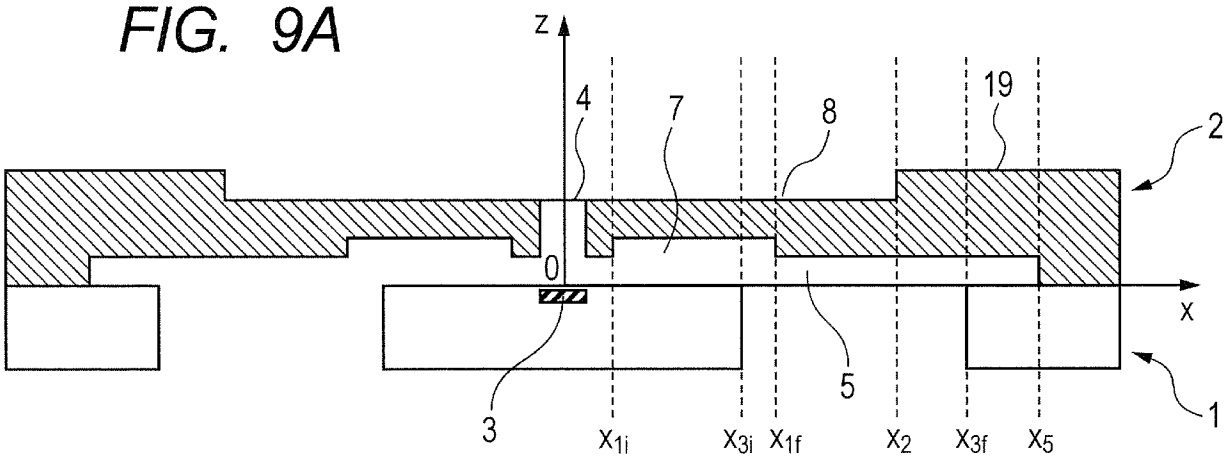
FIGS. 9A and 9B are schematic diagrams illustrating the positional relationship between a groove in a front surface and a groove in a back surface in the second embodiment.
Figure 9B:
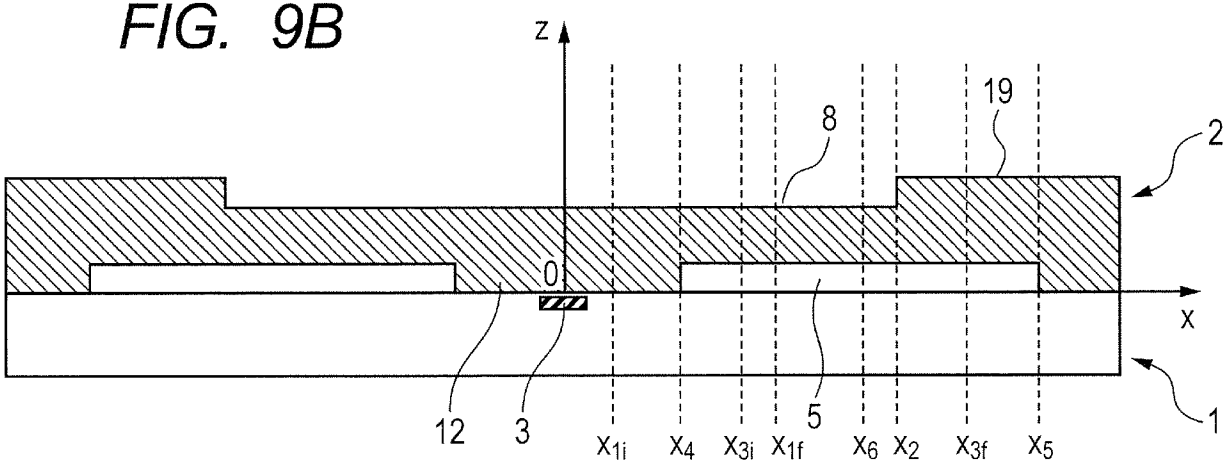

The positional relationship between the front surface groove 8 and the back surface groove 7 is shown in FIGS. 9A and 9B. FIGS. 9A and 9B are schematic diagrams illustrating the positional relationship between the front surface groove 8 and the back surface groove 7, in which FIG. 9A is the schematic diagram of section 7B-7B in FIG. 7A, and FIG. 9B is the schematic diagram of section 9B-9B in FIG. 7A. The lateral direction of the silicon substrate is denoted by x, the longitudinal direction thereof is denoted by y (refer to FIG. 7A), the direction perpendicular to the front surface of the silicon substrate 1 is denoted by z, and the center of an energy generating element 3 is denoted by 0. Further, in the lateral direction (the x-direction) of the orifice substrate 2, the positions of the grooves 7 and 8 or a liquid supply port 6 that are close to position 0 are defined as the initial positions, while the positions away from position 0 are defined as the final positions.

The distance of each position from position 0 is denoted as follows. The initial position of the back surface groove 7 is denoted by $x_{1i}$, the final position of the back surface groove 7 is denoted by $x_{1f}$, the edge position of the front surface groove 8 is denoted by $x_2$, the initial position of the liquid supply port 6 is denoted by $x_{3i}$, the final position of the liquid supply port 6 is denoted by $x_{3f}$, the position of the end of a wall 12 is denoted by $x_4$, the position of the end portion the orifice substrate 2 joined to the silicon substrate 1 at the central side of the orifice substrate 2 is denoted by $x_5$, and the midpoint between position $x_4$ and $x_5$ is denoted by $x_6$.

The preferable placement and height of the back surface groove 7 are the same as those in the first embodiment. The front surface groove 8 is further preferably disposed such that the following conditions are satisfied.

(1) Edge position $x_2$ of the front surface groove 8>Final position $x_{1f}$ of the back surface groove 7

(2) Edge position $x_2$ of the front surface groove 8<Joint position $x_5$ (3) Edge position $x_2$ of the front surface groove 8>Midpoint $x_6$ between position $x_4$ and position $x_5$ Regarding (1), considering the effect for reducing the deformation that causes the height of the passage 5 to decrease, the positional relationship indicated in (1) is preferable. The same reasons as those in the first embodiment apply to (2) and (3).

Figure 10:
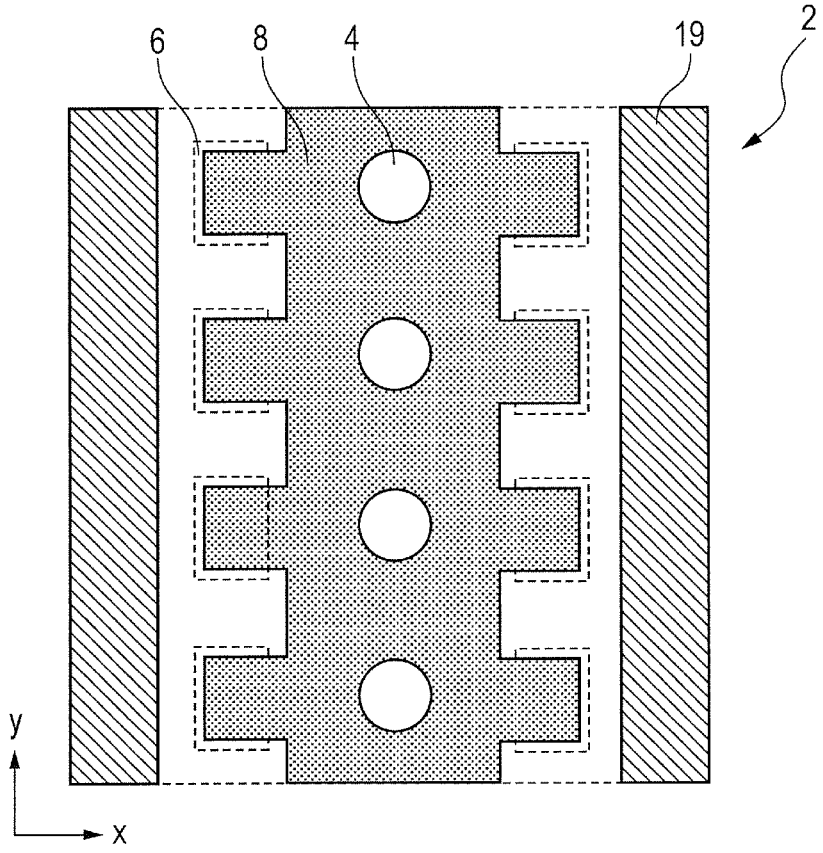
FIG. 10 is a schematic configuration diagram of another example of the liquid discharge head of the second embodiment.

As long as the effect for restraining the deformation of the orifice substrate 2 at the front surface groove 8 is expected, the edge position $x_2$ of the front surface groove 8 may be shaped such that the width of the front surface groove 8 partly narrows in the longitudinal direction of the orifice substrate 2 rather than remaining constant, as illustrated in FIG. 10. Further, the front surface groove 8 or the back surface groove 7 may be split.

As described above, there are no particular restrictions on the depth of the front surface groove 8, and the depth may be designed to provide a predetermined passage resistance. The liquid discharge head 10 according to the present embodiment may be fabricated by the same process as that of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-164173, filed Jul. 27, 2011, which is hereby incorporated by reference herein in its entirety.

What is claimed is:

1. A liquid discharge head comprising:

a first substrate having an energy generating element for discharging a liquid; and a second substrate which is bonded to the first substrate and which has a discharge port for discharging the liquid and a groove that forms a passage for supplying the liquid to the energy generating element, wherein one surface of the second substrate on a side of a front surface of the liquid discharge head and a side of the other surface thereof, which is a back surface of the one surface, are individually provided with recesses, and wherein the second substrate is provided with a wall that defines the passage, and in a lateral direction of the second substrate, a midpoint between a position of one of end portions of the second substrate, which end portion is bonded to the first substrate and adjacent to a central portion of the second substrate, and one of positions of the wall which is adjacent to the end portion of the second substrate, is located at the recess in the one surface of the second substrate.

2. The liquid discharge head according to claim 1, wherein the recess in the other surface of the second substrate is provided in a portion that constitutes the passage.

3. The liquid discharge head according to claim 1, wherein the recess in the one surface of the second substrate is staggered from the recess in the other surface and the discharge port, as observed from the front surface of the liquid discharge head.

4. The liquid discharge head according to claim 1, wherein the first substrate and the second substrate are made of a resin material.

5. A liquid discharge head comprising:

a first substrate having an energy generating element for discharging a liquid; and a second substrate which is bonded to the first substrate and which has a discharge port for discharging the liquid and a groove that forms a passage for supplying the liquid to the energy generating element, wherein one surface of the second substrate on a side of a front surface of the liquid discharge head and a side of the other surface thereof, which is a back surface of the one surface, are individually provided with recesses, and wherein, in a lateral direction of the second substrate, the recess in the other surface of the second substrate is positioned closer to the discharge port than to a position of a midpoint between a position of an end of an edge portion of the second substrate, which edge portion is bonded to the first substrate and which end is adjacent to a central portion of the second substrate, and the position of and end of the wall, which defines the passage, which end is adjacent to an end of the second substrate.

6. A liquid discharge head comprising:

a first substrate having an energy generating element for discharging a liquid; and a second substrate which is bonded to the first substrate and which has a discharge port for discharging the liquid and a groove that forms a passage for supplying the liquid to the energy generating element, wherein one surface of the second substrate on a side of a front surface of the liquid discharge head and a side of the other surface thereof, which is a back surface of the one surface, are individually provided with recesses, and wherein, in a lateral direction of the second substrate, the recess in the other surface of the second substrate overlaps the liquid supply port, as observed from the front surface of the liquid discharge head.

* * * * *